US008770270B2

(12) United States Patent
Wilson

(10) Patent No.: US 8,770,270 B2
(45) Date of Patent: Jul. 8, 2014

(54) DOUBLE STRING SLURRY PUMP

(75) Inventor: Dennis R. Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 536 days.

(21) Appl. No.: 13/076,064

(22) Filed: Mar. 30, 2011

(65) Prior Publication Data

US 2012/0080199 A1 Apr. 5, 2012

Related U.S. Application Data

(63) Continuation-in-part of application No. 12/895,019, filed on Sep. 30, 2010.

(51) Int. Cl.
*E21B 43/12* (2006.01)

(52) U.S. Cl.
USPC ..... 166/68; 166/105; 417/555.2

(58) Field of Classification Search
USPC ..... 166/105, 107, 372, 109, 68; 417/547, 417/555.2
See application file for complete search history.

(56) References Cited

U.S. PATENT DOCUMENTS

| | | | | |
|---|---|---|---|---|
| 4,089,374 | A | 5/1978 | Terry | |
| 4,207,035 | A | 6/1980 | Perr et al. | |
| 4,207,036 | A | 6/1980 | Secrist | |
| 4,274,487 | A * | 6/1981 | Hollingsworth et al. | 166/261 |
| 4,358,248 | A * | 11/1982 | Bodine | 417/53 |
| 4,621,693 | A | 11/1986 | Caldwell et al. | |
| 4,694,901 | A | 9/1987 | Skinner | |
| 5,944,100 | A | 8/1999 | Hipp | |
| 6,520,260 | B1 | 2/2003 | Stone | |
| 7,316,268 | B2 | 1/2008 | Peleanu et al. | |
| 2006/0002808 | A1 * | 1/2006 | Williams | 417/555.1 |
| 2006/0278398 | A1 | 12/2006 | Ruggeri et al. | |
| 2011/0067883 | A1 | 3/2011 | Falk et al. | |
| 2011/0073317 | A1 | 3/2011 | Wilson | |
| 2011/0073318 | A1 | 3/2011 | Wilson | |
| 2011/0073319 | A1 | 3/2011 | Wilson | |

FOREIGN PATENT DOCUMENTS

| | | |
|---|---|---|
| CA | 2278827 | 1/2001 |

OTHER PUBLICATIONS

PCT/US12/29824 (PCT/ISA/210) International Search Report dated Jun. 15, 2012.
"Technical Support Package for Wide-Band Radar for Measuring Thickness of Sea Ice", NASA Tech Brief NPO-45565.
PCT/US2012/29824 PCT International Search Report Dated Jun. 15, 2012 (PCT/ISA/210).

* cited by examiner

*Primary Examiner* — Shane Bomar
*Assistant Examiner* — Wei Wang
(74) *Attorney, Agent, or Firm* — ConocoPhillips Company

(57) ABSTRACT

The invention relates to a double string slurry pump for pumping liquids to the surface of a hydrocarbon well and especially a hydrocarbon well that is producing both natural gas and liquid fluids. The double string slurry pump includes a hollow tube that raises and lowers the plunger and carries the liquids to the surface and an outer tube receives liquids down into the well to periodically flush area around the pump to stir up particles and fines for conveyance out of the wellbore with the liquids. The additional conduit for flushing may be used to provide biocides, solvents or other treatments including with liquids at elevated temperature to create desired results or changes downhole. Moreover, the additional conduit may be provided with ports to provide access to the interior of the gas production path to provide such treatments above the well. The natural gas is produced through the annulus between wellbore casing and the outer production tubing string.

22 Claims, 4 Drawing Sheets

DOUBLE STRING SLURRY PUMP

CROSS-REFERENCE TO RELATED APPLICATIONS

This application is a continuation-in-part patent application which claims benefit under 35 USC §120 to U.S. patent application Ser. No. 12/895,019 filed Sep. 30, 2010, entitled "Double String Pump for Hydrocarbon Wells," which is incorporated herein in its entirety.

STATEMENT REGARDING FEDERALLY SPONSORED RESEARCH OR DEVELOPMENT

None.

FIELD OF THE INVENTION

This invention relates to down hole rod pumps that are typically used to pump liquids from the bottom of a hydrocarbon wells.

BACKGROUND OF THE INVENTION

As one travels through Texas and Oklahoma and other oil producing regions, it is common to see oil wells with rocking beam pumps in action. The beam is rocked like a seesaw by a motor while one end the beam lifts and lowers a sucker rod string to drive a pump positioned at or neat the bottom of the well. The sucker rod string is typically made up of a number of twenty-five foot to thirty foot steel rod sections connected end to end to form a long string of rods that extend down into the production tubing of a well. The production tubing itself was inserted into the wellbore after the wellbore was drilled and cased. The production tubing is fixed in the wellbore with a down hole rod pump positioned near the bottom. As the sucker rod moves up and down in the production tubing, the pump draws liquids from the wellbore into a chamber of the pump through a first check valve during a first stroke and then pushes the liquids in the chamber through a second check valve during the return stroke. The liquids pass through the second check valve and into the production tubing above the pump so that the liquids are eventually pumped to the surface and are either piped or trucked to market.

Natural gas wells and many low rate oil wells are sometimes provided with pumps to periodically withdraw liquids that enter the wellbore from the formation and tend to accumulate and slowly and eventually stop the production of hydrocarbons the natural gas. The liquid may be water, but may also include hydrocarbon liquids which are sufficiently valuable to collect and transport to market.

One of the problems associated with pump systems for small volumes of liquids in wells is that any solids, particularly fines and small particles, that are produced tend to collect and cause trouble for the pump. If the liquid volume were substantially higher, the particles would likely be carried to the surface and not collect at the bottom of the production tubing. With low liquid production rates and intermittent pumping, the particles tend to collect in the production tubing on top of the pump and have been known to damage the pumps and pumping systems well short of their expected service life. This can be especially challenging in coal seam gas production wells where the particles tend to be very fine and abrasive and are susceptible of stacking out rod strings by caking up and packing between plungers and barrels and blocking the travel of check valves and other vital pumping equipment. Coal seam gas wells typically produce water along with highly abrasive coal fines.

Many other wells produce sand which is a problem on a much larger scale in terms of total numbers of pumps exposed to particles. Some wells have sand delivered into the formation to hold open the fissures, fractures and perforations to enhance production of gas and liquids. This kind of sand is called proppant. Unfortunately such proppant sand causes many rod pump failures every year as some amounts exit the formation and creates hazard for moving equipment such as the pump in the wellbore. Another type of sand that is even more difficult for pumps to handle is formation sand, often referred to as flour sand. Formation sand is quite fine in nature and very difficult to control due to its fine size and mobility. It is highly abrasive and will wear out the polished surfaces of a pump or bury and stack out the pump.

SUMMARY OF THE INVENTION

The invention relates to a system for producing gas and liquids from a well where a pump is positioned at or near the bottom of the well and three conduits are arranged to extend into the well from the surface down near the bottom of the well. The first of the three conduits produces gas to the surface and the second of the three conduits is connected to the pump to produce liquids to the surface. The third of the three conduits provides a path for liquid to be delivered to the area of the pump.

In another aspect, the invention more particularly includes a system for producing liquids and solids from the bottom of a hydrocarbon well where the system includes a string of production conduit installed in a wellbore where a lower end thereof is near the bottom of the well and where the production conduit defines a gas production path to the surface on one side and an access conduit on the other. A pump including a barrel and a plunger wherein is positioned at the lower end of the production conduit and a string of hollow rod is disposed within the production conduit such that a tubing annulus is formed around the hollow rod string and where the hollow rod string is connected to the plunger that is positioned within the barrel of the pump for movement up and down within the barrel. The production tubing further includes at least one port for delivering liquid from the tubing annulus to the gas production annulus.

The invention also relates to a process for producing liquids and solids from the bottom of a natural gas well where an open ended string of production conduit is installed into a wellbore with a seating nipple near the open lower end of the production conduit to define a gas annulus outside of the production conduit and within the well. A pump is installed at the end of a string of hollow rod where the pump includes a barrel and a hollow plunger and where the hollow plunger is connected to and in fluid communication with the hollow rod string and further includes a traveling valve to admit liquids into the hollow interior of the plunger and wherein the barrel includes a standing valve to admit liquids from below the seating nipple into the barrel. The barrel is connected to the seating nipple and seals the interior of the production tubing from the open lower end of the production tubing wherein a tubing annulus is defined within the production tubing above the seating nipple and outside the hollow rod string. Substantially particle free liquid is provided into the tubing annulus to be in contact with the barrel and the outside of the plunger and to pass into the gas annulus to slurry solids and the plunger is raised and lowered to draw liquids through the standing valve and through the traveling valve and directing the liquids into the hollow rod string.

In particular aspects of the invention includes the capability to pump or inject clean liquid, chemically treated liquid, or hot liquid within the tubing annulus on top of the barrel and plunger and allow to exit said annulus anywhere up or down the wellbore.

The ball checks break the volume above the pump into segments to minimize the suspended solids in any one segment that can settle on top of any one ball check. The volume between these ball checks is sized so that expected pump cycle volume before pump off occurs is greater than the volume between the ball checks so that liquid and solids is advanced above the next ball check or more before the pump shuts down.

In a preferred arrangement, a portion of the liquids are produced through the hollow rod string are directed through a filter or settling tank system and then back into the tubing annulus.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

Figure 2:
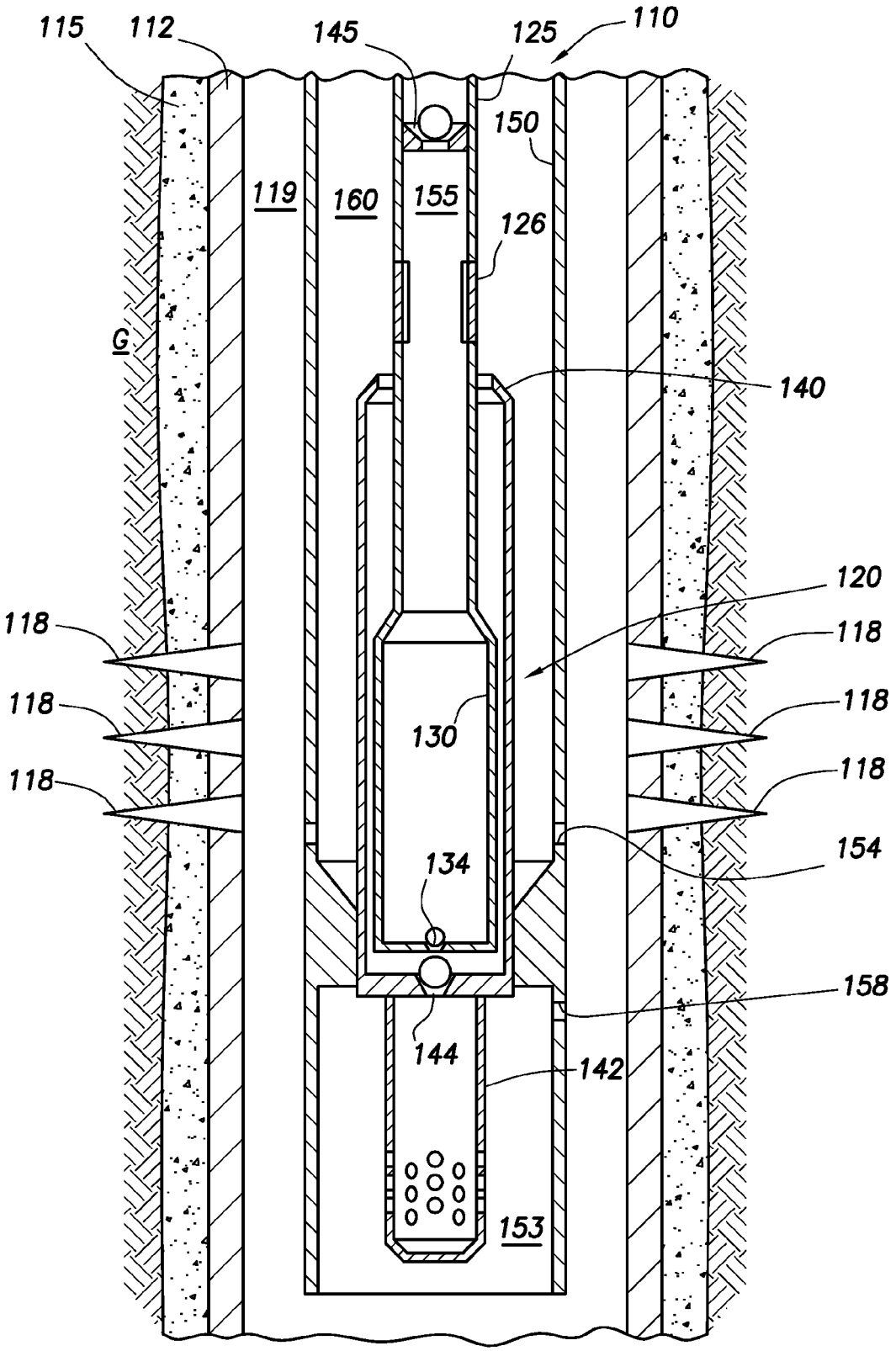
FIG. 2 is a cross section of a first embodiment of an inventive pumping system shown in a well for pumping liquids to the surface of a natural gas well.

While the explanation of this invention will include the description of conventional components of a pump in a well, a key feature of the invention is the inclusion of an additional conduit that extends from the surface down the well to the vicinity of a pump at the bottom of the well. This additional conduit provides operators and well owners with access to the pump and to other locations down the wellbore to flush the well or provide important chemical treatments to the pump or to the well. Such access to the wellbore and to the pump should enable gas wells to be better maintained and problems to be resolved that are currently quite challenging. The additional conduit is shown in FIG. 2 and identified as tubing annulus 160. Tubing annulus 160 can be described as an additional conduit as a produced liquid flow path 155 is inside the hollow rod string 125 and the gas annulus 119 provides the conduit for the gas to flow to the surface. Tubing annulus 160 provides immediate access to the pump 120 without interfering with either of the conduits for produced gases and liquids.

Now turning to a more complete explanation of the full wellbore installation, in FIG. 2, a wellbore, generally indicated by the arrow 110, is shown formed or drilled into the ground G. According to conventional procedures, casing 112 is positioned in the wellbore 110 and sealed against the wall of the wellbore with cement 115. Perforations 118 are extended through the casing 112 and into a hydrocarbon-bearing formation in the ground G by explosive charges to permit hydrocarbons in the hydrocarbon-bearing formation to flow back into the wellbore 110. The natural gas and other gases are permitted to ascend up the wellbore 110 through gas annulus 119 while liquids accumulate at the bottom of the wellbore 110.

Figure 1:
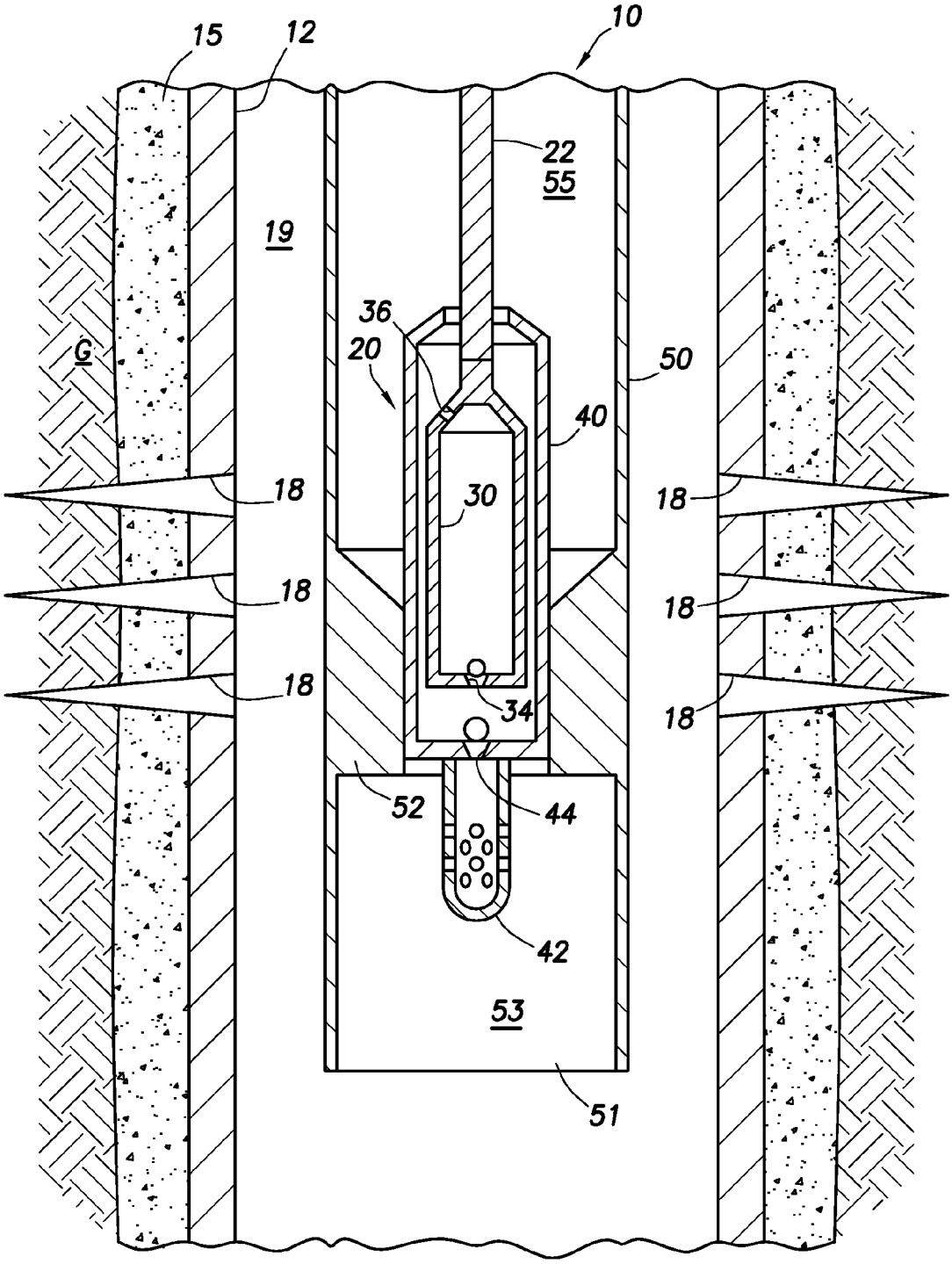
FIG. 1 (PRIOR ART)
FIG. 1 is a cross section of a prior art version of a pumping system for pumping liquids to the surface of a natural gas well.

The completion of a conventional gas well would include the insertion of a production string 150 that includes a seating nipple 152 for a pump 120 to be inserted. However, in the present invention, the pump 120 is inserted to the seating nipple using hollow rod string 125 with a plunger 130 arranged to deliver liquid contents into the interior of the hollow rod string 125. For comparison, please refer to FIG. 1 where a pump 20 is connected to the surface and installed using conventional sucker rod 25. The liquid production path 55 is inside the production tubing 50. In FIG. 1, there are only two conduits to the surface. In FIG. 2, a third conduit is formed in the tubing annulus 160 between the production tubing 150 and the hollow rod string 125.

The pump is in the natural gas well to pump off, liquids that are produced from the formation with the natural gas. Liquids that accumulate in the well and tend to slow or block the production of the natural gas into the wellbore 10 or 110 so it is generally more productive to maintain the level of liquids below the lowest of the perforations 18 or 118. The liquid level is drawn down by the pump 20 or 120 from the bottom end of the production tubing 50 or 150, called a quiet zone 53 or 153 below the pump 20 or 120 and the seating nipple 52 or 152.

The pump 20 or 120 includes a plunger 30 or 130 arranged to move up and down within the barrel 40 or 140. The plunger 30 or 130 is attached to the bottom end of a hollow rod string 22 and is able to move up and down within the barrel 40 or 140 that is firmly connected or locked into the seating nipple 52 or 152, but it should be understood that the periphery of the plunger 30 or 130 and the interior of the barrel 40 or 140 are each machined and sized so that any liquid flow around the plunger 30 or 130 is substantially restricted. The preferred path for liquids to travel through the barrel 40 or 140 is also through the interior of the plunger 30 or 130. Below the barrel 40 or 140 is a strainer nipple 42 or 142 having a number of holes to allow liquids or gas that is in the quiet zone 53 or 153 to pass into the barrel through stranding valve 44 or 144. Standing valve 44 or 144 is shown to be a ball and seat, but may be any suitable one-way valve technology. As the plunger 30 or 130 is lifted relative to the barrel 40 or 140, liquids are drawn up through the strainer nipple 42 or 142 and through standing valve 44 or 144 to fill the space in the barrel 40 or 140 below the plunger 30 or 130. The plunger 30 130 includes a travelling valve 34 or 134, that like the standing valve 44 or 144, is shown as a ball and seat, but may be any suitable one-way valve technology. As the plunger 30 or 130 is lowered in the barrel 40 or 140, standing valve 44 or 144 closes to keep liquid in the barrel but unseat the travelling valve 34 or 134 so that the liquids in the barrel below the plunger 30 or 130 would enter and flow into the plunger 30 or 130. Liquids that were already in the plunger 30 or 130 before the plunger began its downward movement in the barrel exit the top of the plunger 30 or 130. In FIG. 1, the liquids exit the top of the plunger 30 through one or more vent holes 36. Liquids that pass out of the vent holes 36 fill the production path 55 and are eventually delivered to the surface.

In FIG. 2, the liquids exit the top of the plunger 130 into the hollow rod string 125 through check valve 145.

In operation, gas wells often produce sand and other particles that can accumulate at the bottom of the wellbore and cause considerable problems with the pump and interfering with the flow of the liquids into the quiet zone 53 or 153. The liquid flow rates into gas wells is a relative trickle, and as such, the pump 20 or 120 is expected to operate intermittently to lift liquids out of the bottom of the wellbore 10 or 110. At the same time, the liquid flow rates are so slow as to allow the solids to settle at the bottom of the well. The excessive collection of solids, especially particles and fines, are a likely cause of pump failure in a well and can plug off the gas annulus 19 or 119 from the quiescent zone 53 or 153. Using the additional access to the pump area via the tubing annulus 160, a rush of particle free liquid may be flushed from the surface and progress rapidly to the bottom of the well to jet through ports 154 and into the gas annulus 119. The jet of such liquids are intended to stir the solids in the bottom of the wellbore to effectively create a slurry of liquids and suspended particles and fines for removing from the well via the pump 120 and liquid production path 155. The liquids may also scrub the surrounding area to dislodge particles and debris from inside the gas annulus. In some cases, fungus and bacteria may grow inside the well and biocides may be includes with the liquids. The jetting action and other liquid scrubbing effects of the rush of liquid may aid the effectiveness of the biocides. Also, some wells produce waxes and paraffins that may also plug up the production of either or both liquids and gas. Heated liquids and solvents may be added to the liquids to help remove and carry away the waxes and paraffins with the slurry being pumped through the liquid production path 155.

In prior art arrangements such as shown in FIG. 1, a number of process or operational schemes may be employed. Typically, the pump 20 is started based on elapsed time from the most recent pump operation cycle and continues until a reduced weight of the plunger 30 is detected, meaning that the liquids at the bottom of the well are reduced and that the pump 20 has had a gas break through. One of the problems with this arrangement that has been identified by the inventor is that particles such as sand and grit are going to pass into the and through the pump 20, but tend to settle back down in the production path 55 during times of inactivity. In some wells, it is common for just a barrel or two or three barrels to be pumped off the bottom to maintain natural gas production, but these few barrels may not make it to the surface for days or weeks. By the time a specific volume of liquid makes it to the surface, whatever small solids that were entrained with the liquid are substantially settled out. Perhaps these solids may be stirred up during a pumping cycle, only small amounts of the solids ever make it to the surface. These solids collect around the top of the pump 20 and are prone to cause premature failure of the pump by getting into the top of the gap between the outside of the plunger 30 and the inside of barrel 40. Wear on these highly machined surfaces will likely eventually cause a pump failure.

To alleviate these and other problems identified in the embodiment of FIG. 1, a pumping system is shown in FIG. 2 where similar elements are identified with similar numbers except being three digit numbers with the first digit being "1". For example, casing 112 in FIG. 2 is essentially the same element as casing 12 in FIG. 1.

Focusing on the differences between the invention and the embodiment in FIG. 1 is a plunger 130 is moved up and down inside the barrel 140 by a hollow rod string 125. The hollow rod string 125 is similar to sucker rod 22, but is hollow in the center to define the liquid production path 155 inside the hollow rod string 125. The diameter or effective cross section of the hollow rod string 22 is much smaller than the production path 55 in FIG. 1, thus, while each stroke of the pump 120 may move the same volume of liquid as a stroke of pump 20, the produced liquid moves at a higher velocity up the hollow rod string 125 and gets far closer to the surface for each stroke. With higher velocity, the entrained solids are more likely to be carried farther up the production path 155 with the liquid during each pump operation cycle. Secondly, check valves, such as shown at 145, are provided at several locations up the production path 155 so that when a pumping cycle is ended and the pump 120 is idled, the particles will only settle down to the top of the last check valve 145 each particle may have passed while travelling to the surface. At a minimum, the check valves or ball checks 145 are spaced within the string so that the volume between them does not exceed the volume expected to be pumped during each a pumping cycle so that particles pass through at least one check valve during each pump cycle and are preferably spaced closer together so that the liquids in the liquid production cycle would pass at least two check valves 145 for each cycle of pump operation. Also, with the smaller diameter in the production path 155, the pump rate or liquid velocity within the liquid production path should equal or exceed the lift velocity required for the well and for the re-entrainment of the solids into the liquid flow. With a sufficiently small diameter of the rod string 125, re-entrainment of the solids should be quicker and more certain.

Figure 3:
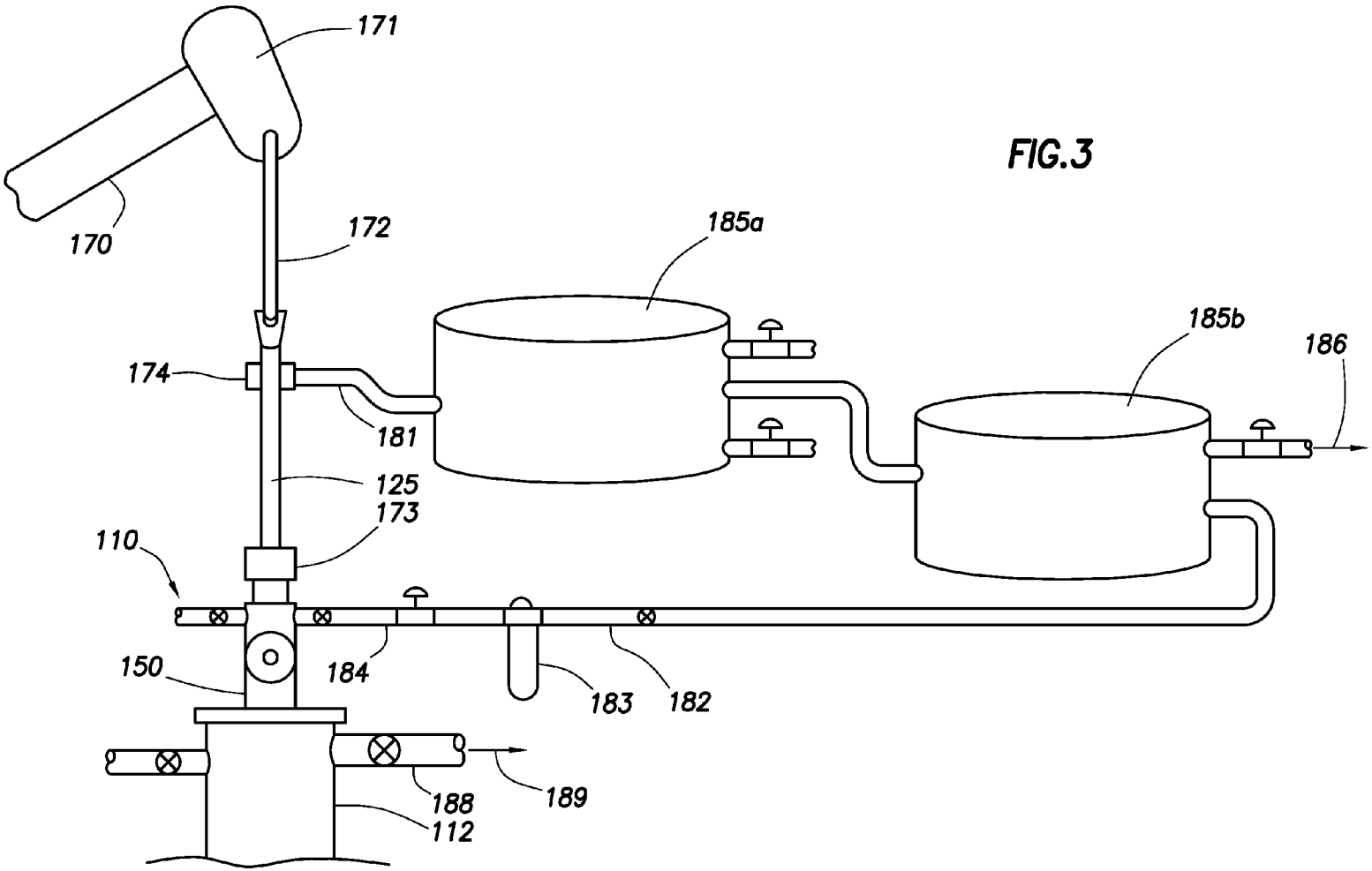
FIG. 3 is a fragmentary perspective view of the surface of the well showing the arrangement for providing filtered liquid back to the bottom of the production tubing.

Turning now to FIG. 3, the downhole pump 120 and well completion arrangement including the production tubing 150 and hollow rod string 125 are operated and supported at the surface by a rocking beam 170 and pipes and vessels. The rocking beam 170 includes a horse-head shaped bracket 171 that is positioned at the end of the rocking beam 170 with a linkage 172 connected to the upper end of the hollow rod string 125. As the rocking beam 170 lifts and lowers the bracket 171, the hollow rod string 125 raises and lowers through packing 173. Packing 173 seals the top of the annulus within the production tubing 150 and outside the hollow rod string 125 as the hollow rod string telescopes in and out of the wellbore 110. A swivel 174 at the top of the hollow rod string connects to a flexible hose 181 to the interior of the hollow rod string 125 to carry liquids produced from the hollow rod string 125 to a separation vessel **185*a* where solids are allowed to sink, gases may separate to the top and clean liquid is transferred on to storage tank 185*b*. The liquids may be delivered to market as indicated by the arrow 186 or recycled back into the well bore 110 through conduit 182. The liquids may be filtered by any acceptable filtering technology such as a cartridge filter 183. The clean liquids are then directed through conduit 184 into piping that leads to the inside of production tubing 150. Natural gas that has passed up the annulus 119 to the top of the well is directed into gas gathering line 188 to be conveyed to market as indicated by arrow 189**.

In wells that produce problematic volumes of solids, the solids will tend to settle to the bottom of the hole and even begin to fill the gas annulus 119 while the pump 120 is not in operation. To flush these solids, just prior to initiation of the pump cycle, some of the liquid in tank **185*b* is delivered into the tubing annulus 160 to pass to the bottom thereof and pass through ports 154. Preferably, a significant volume of liquids are directed into the tubing annulus 160 to blow through the ports 154 with force to stir the solids and create a large volume of a slurry comprised of a lot of fluid and fine and small sized particles. What the inventor has noticed is that once enough liquid has entered the tubing annulus 160 that the weight of the liquid has exceeded the gas pressure, the liquid then siphons more and more liquid into the tubing annulus 160. Preferably, only an amount of liquid that can be pumped by the pump 120 in a reasonable period of time, such as one hour, is allowed into the tubing annulus. Gas from the gas annulus is allowed to fill the tubing annulus 160 behind or above the added liquids. With the liquid flushing and treating the wellbore, the slurry is then drawn into the pump 120 through the strainer nipple 142 and through the standing valve 144 as described above. The pump 120 continues to pump as liquid is continually delivered to tubing annulus 160 until the solids content of the liquid has satisfactorily diminished or until the volume of clean liquid in tank 185***b* is depleted. The advantage of delivering clean fluid down the tubing annulus 160 is that it remains clean all the way to the ports 154 and thereby prevents the high solids slurry from vulnerable locations inside the barrel 140 near the top of the plunger 130.

Thus, the plunger 130 has clean liquid around the outside thereof and to the extent that any filtered liquid might pass along the small gap around the outside of the plunger 130 and within the barrel 140, it would tend to sweep any particles in that gap back into a location where such particles are directed up into production path 155.

At the end of the pump operation cycle, it is preferred that the plunger 130 is in the "up" position so that if gas had entered the space below the bottom of plunger 130 and above standing valve 144 that some amount of filtered liquid in the barrel 140 would pass through the small gap during the idle time and occupy enough space to unseat the traveling valve 134 before the plunger reaches it full bottom stroke. As long as the travelling valve 134 can be unseated, the gas will quickly pass into the plunger and the gas lock condition will be alleviated without having to undertake substantial intervention. In an alternative embodiment, double standing and double travelling valves may be preferred where fluid travels through a first of the double valves and then through the second. A double valve arrangement provides redundancy in the event that solid particles block open one of the valves. It is preferred that once the liquid at the bottom of the wellbore 110 is depleted that the pump be stopped. With minimal liquid volumes to be pumped, the velocity of the liquids in liquid production path 155 tends to diminish below the speed which fully entrains the solids. As emphasized above, it is highly desirable to produce the fines and particles to the surface. It is generally seen that vertical velocities of about one half of one foot per second or greater (≥0.5 fps) is sufficient to entrain most solids.

In the preferred operation of the well, the pump is stopped in the "up" position until a pump cycle is ready to be undertaken (whether due to elapsed time, reduced gas production or by initiation of an operator at the surface, etc.) a volume of clean liquid is delivered to the tubing annulus 160 from the tank 185*b*. The pump area of the well is flushed with the liquids stirring up fines and particles while accomplishing any other intended treatments at the bottom or at other locations at predetermined locations higher in the well. With the fines and particles having been stirred into the liquid, the pump 120 is started and begins its operation of up and down movements to pump the slurry or liquid with suspended fines and particles to the surface. The slurry progresses up the interior of the hollow rod string 125 along the liquid production path 155 at a velocity that will re-entrain fines and particles that have settled out of the liquid from the previous pump cycle back into the liquid to be carried to the surface. The fines that had settled out should have only settled on the top of the last check valve that the slurry passed before the pump shut down at the end of the previous pump cycle. Once the liquid level has been pump down, conventional pump-off control technology detects that the liquid level has diminished and preferably shuts down the pump and ends the pump cycle. With a substantial volume of liquid delivered to the tubing annulus, all of the liquid and solids in the liquid production path is preferably completely produced to the surface along with a substantial portion of newly added liquid. However, some operational schemes may not include a great amount of new liquid so the spacing of the check valves 145 may be more important ins some wells so that any fines that enter the interior of the hollow rod string 125 progress beyond at least one additional check valve at each pump cycle including the recognition that such fines will need to be re-entrained at the start of each pump cycle and therefore on top of a check valve and must flow all the way beyond the next check valve to eventually make it fully to the surface. Such calculations to making sure that solids progress is to space the check valves at a distance that is less than the minimum volume of liquid expected to be pumped for each pump cycle. A reasonable margin of error may be to space the check valves at one barrel distances (depending on the diameter of the hollow rod, about 1000 feet) or at one half barrel distances if the minimum expected volume will be 1 or 2 barrels.

While abrasion and wear are the primary concern of the inventor, another aspect of the present invention that may help avoid gas locks is to provide a vent 158 to allow any gas that has entered the quiet zone 153 such as gases dissolved from the hydrocarbon liquid to pass back into the annulus 119 and exit the well 10. The vent 158 is above the highest opening in the strainer nipple 142 so that the liquid level inside the quiet zone 153 is not lower than the liquid level outside the quiet zone in the annulus 119. Another strategy to alleviate gas lock is to increase the fluid slippage past the plunger/barrel interface from annulus 160 into barrel 140 to displace traveling valve 134 and push gas into flow path 155.

Chemical treatments such as a scale, corrosion or paraffin inhibitor may be added into production tubing 150 or into the tubing annulus 160. It should be noted that even hot liquid such as hot water or oil may be added to tubing 150 to enhance production by softening paraffins. The tubing annulus 160 provides many new options for addressing a near endless list of challenges in the oil field.

In one further preferred aspect related to FIG. 3, a rod rotator may be installed at the top of the well near the location where the bracket 171 attaches to the hollow rod string 125 to rotate the hollow rod string 125 and spread any wear from the up and down motion evenly around the outside of the sucker 125 for longer rod string life. Also, with the rod string 125 being hollow, it will likely and preferably have a larger diameter than equivalent non-hollow rod string of the same strength and will therefore have a larger radius distributing any load on the inside of the production tubing 150 in a manner that will reduce wear on the production tubing 150.

While it should be understood that the invention introduces two tubing strings which enables operators of wells to control the operating environment of the pump 120. The invention provides a way to flush water or other liquid to the pump from above through the tubing annulus 155.

Figure 4:
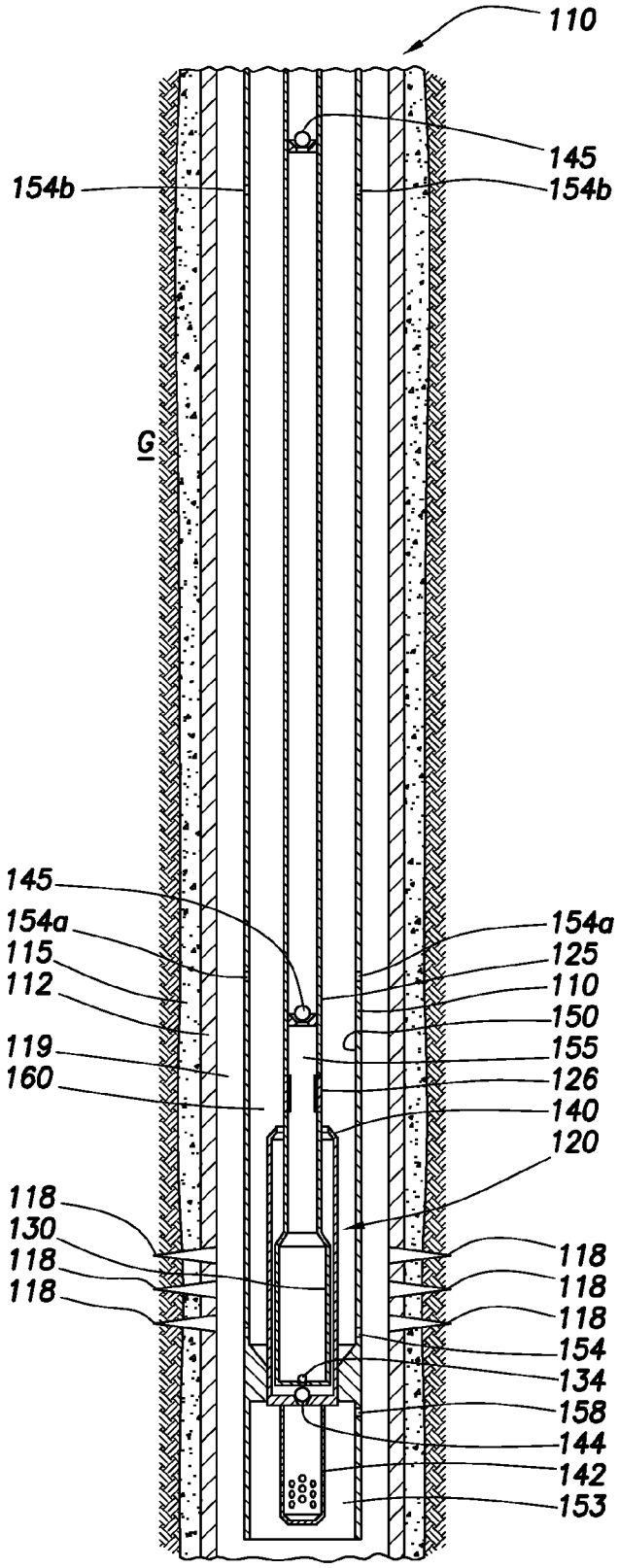
FIG. 4 is a cross section showing a longer length segment of the invention particularly showing check valves and ports at higher elevations in the wellbore.

Turning to FIG. 4, the production tubing 150 may include additional ports 154*a* at an elevation above the barrel 140 and further ports 154*b* at various levels above that. With these additional ports, liquids and treatments including hot fluids and chemical treatments may be directed into the gas annulus 119 for treatments as desired. Tools may be inserted into the tubing annulus below ports 154*a* or 154*b* so that the flow of such liquids and treatments may be directed with more focus into the gas annulus at the location desired.

One interesting aspect of this arrangement is that with the liquids coming to the surface within a hollow rod string, the liquids exit the well pumping system on the "downstroke" of the rod pump. In conventional rod pumps, the liquid production occurs on the "upstroke." This point may not seem significant, but it does reveal that the present invention is quite different than prior systems.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A system for producing liquids and solids from the bottom of a hydrocarbon well where the system comprises:

a) a string of production tubing installed in a wellbore where a lower end thereof is near the bottom of the well and where the production tubing defines a gas production annulus outside the production tubing and within the well for gas to be produced to the surface;

b) a pump comprising a barrel and a plunger wherein the barrel is attached to the production tubing near the lower end of the production tubing;

c) a string of hollow rod disposed within said production tubing such that a tubing annulus is formed around the hollow rod string and inside the string of production tubing and where the hollow rod string is connected to the plunger that is positioned within the barrel of the pump for movement up and down within the barrel and where the liquids exit the top of the plunger into the hollow rod string to be produced to the surface on a downstroke of the pump and the liquid is produced to the surface through the hollow rod; and d) wherein the production tubing includes at least one port for delivering liquid from the tubing annulus via the surface to the gas production annulus.

2. The system according to claim 1 further including check valves within the hollow rod string to prevent particles that might settle in liquid from descending past the check valves and maintaining the particles at a level in the wellbore closer to the surface so that when the pump is operating, the particles are pushed closer and closer to the surface to eventually be fully removed from the well.

3. The system according to claim 1 further including a filter system at the surface for filtering liquid and directing the liquid into the tubing annulus on top of the barrel and plunger.

4. The system according to claim 1 wherein the system more particularly includes a liquid path to the surface is defined where liquid enters the barrel from the well, moves from the barrel into the plunger and then into the string of hollow rod and then to the surface.

5. The system according to claim 1 wherein a gas production annulus is formed between the casing and the production tubing for natural gas to flow to the surface.

6. The system according to claim 1 further including a column of filtered fluid in the tubing annulus that, by gravity resists the flow of any liquid from inside the barrel around the plunger and into tubing annulus and thereby reduce the probability of surface wear on the outside of the plunger and inside of the barrel caused by solids in the production fluids.

7. The system according to claim 1 further including an additive injection system for adding chemical into the tubing annulus for maintenance of the hydrocarbon production equipment.

8. The system according to claim 7 wherein the additive injection system injects scale inhibitor.

9. The system according to claim 7 wherein the additive injection system injects corrosion inhibitor.

10. The system according to claim 1 wherein the port in the production tubing is below the top of the barrel.

11. The system according to claim 1 wherein the port in the production tubing is above the top of the barrel.

12. The system according to claim 10 further including a plurality of additional ports are installed in the production tubing at a plurality of positions above the top of the barrel.

13. A process for producing liquids and solids from the bottom of a natural gas well wherein the process comprises:

a) installing an open ended string of production tubing into a wellbore with a seating nipple near the open lower end of the production tubing to define a gas annulus outside of the production tubing and within the well, wherein natural gas flows through the gas annulus to the surface;

b) installing a pump at the end of a string of hollow rod where the pump includes a barrel and a hollow plunger, wherein the hollow plunger is connected to and in fluid communication with the hollow rod string, wherein the hollow plunger further includes a traveling valve to admit liquids into the hollow interior of the plunger, wherein the barrel includes a standing valve to admit liquids from below the seating nipple into the barrel;

c) connecting the barrel to the seating nipple and sealig the interior of the production tubing from the open lower end of the production tubing wherein a tubing annulus is defined within the production tubing above the seating nipple, outside the hollow rod string and outside the barrel;

d) delivering substantially particle free liquid rapidly from the surface into the tubing annulus to be in contact with the outside of the barrel, the outside of the plunger and the outside of the hollow rod string, wherein the substantially particle free liquid passes into the gas annulus to stir the solids and create a slurry, wherein the slurry includes substantially particle free liquids and solids, wherein gas from the gas annulus is allowed to fill the tubing annulus behind or above the substantially particle free liquids; and e) raising and lowering the plunger by the hollow rod string to draw liquids through the standing valve and through the traveling valve into the plunger, directing the liquids from the plunger into the hollow rod string and through the hollow rod string to the surface.

14. The process according to claim 13 wherein a portion of the liquids produced through the hollow rod string are directed through a filter and back into the tubing annulus.

15. The process according to claim 13 wherein gas is produced through gas production annulus and a quiet zone is defined below the seating nipple above the open end of the production tubing and gas that enters the quiet zone is allowed to exit back into the gas production annulus from an upper portion of the quiet zone.

16. The process according to claim 13 further including the step of adding chemical into the tubing annulus for accomplishing improved hydrocarbon production.

17. The process according to claim 16 wherein the step of adding a chemical comprises adding a scale inhibitor.

18. The process according to claim 16 wherein the step of adding a chemical comprises adding a corrosion inhibitor.

19. The process according to claim 16 wherein the step of adding a chemical comprises adding a paraffin dissolving agent.

20. The process according to claim 13 wherein the step of providing substantially particle free liquid into the tubing annulus further comprises providing the substantially particle free liquid as a back flush for the production tubing.

21. The process according to claim 13 further including the step of preventing solids from flowing and settling back down the hollow rod string on the pump by providing check valves along the length of the hollow rod string so that solids and fluid will advance from one check valve to at least the next check valve during successive pump cycles, even on low fluid volume wells.

22. The process according to claim 13 further including emitting the particle free liquid from the tubing annulus into the gas annulus at a plurality of levels along the production tubing.

* * * * *